US006069610A

United States Patent [19]

Denda et al.

[11] Patent Number: 6,069,610

[45] Date of Patent: May 30, 2000

[54] DRIVE FOR A DISPLAY DEVICE

[75] Inventors: Hayato Denda; Masamichi Nakajima; Asao Kosakai; Junichi Onodera; Masayuki Kobayashi; Seiji Matsunaga, all of Kanagawa-ken, Japan

[73] Assignee: Fujitsu General Limited, Kawasaki, Japan

[21] Appl. No.: 08/557,248

[22] Filed: Nov. 14, 1995

[30] Foreign Application Priority Data

Nov. 25, 1994 [JP] Japan ..... 6-314330

[51] Int. Cl.[7] ..... G09G 5/10

[52] U.S. Cl. ..... 345/149; 345/147

[58] Field of Search ..... 345/147, 149, 345/88, 109

[56] References Cited

U.S. PATENT DOCUMENTS

| | | | |
|---|---|---|---|
| 5,548,305 | 8/1996 | Rupel | 345/149 |
| 5,592,592 | 1/1997 | Shu | 395/109 |
| 5,596,349 | 1/1997 | Kobayashi et al. | 345/147 |
| 5,623,281 | 4/1997 | Markandey et al. | 345/88 |

FOREIGN PATENT DOCUMENTS

| | | |
|---|---|---|
| 0 264 302 | 10/1987 | European Pat. Off. . |
| 0 626 780 A3 | 5/1994 | European Pat. Off. . |
| 6-118920 | 9/1992 | Japan . |

*Primary Examiner*—Matthew Luu

*Attorney, Agent, or Firm*—Flynn, Thiel, Boutell & Tanis, P.C.

[57] ABSTRACT

In an error diffusion processing unit to get a false half tone diffusing in the surroundings the luminance error between the original picture element signal quantizedly input and the preceding data, one dot of said signal is converted into plural picture elements. The respective picture elements (pixels) thus converted are compared with the prior data to detect the luminance error, which will then be weighted by multiplying it with certain coefficient to give, for instance, the reproduced error in one line past, that in one dot past and further the reproduced error a in one-line and one-dot past, which will respectively be added to the original pixels. Producing a false tone by error variance in unit of pixel enables to display the half tone without expanding the half tone display area beyond required dot number.

3 Claims, 7 Drawing Sheets

DRIVE FOR A DISPLAY DEVICE

BACKGROUND OF THE INVENTION

1. Field of the Invention

This invention relates to the display driving method and drive that can have a high density and fine image by constituting one dot of input signal with plural picture elements and displaying the half tone by way of error diffusion in unit of pixel.

2. Description of the Prior Art

Recently PDP (Plasma Display) has been attracting a great deal of public attention as a thin, light-weighted display device. Totally different from the conventional CRT drive system, the drive method of this PDP is a direct drive by means of digitalized image input signal. Consequently, the luminance and tone of the light emitted from the panel face depends on the bit number of the signal to be processed.

PDP may be divided into two types: AC and DC types whose basic characteristics are different from each other. The DC drive type PDP has reportedly improved the luminance and service life which had been one of the longstanding questions. This type of PDP is therefore progressing toward its commercial use.

AC type features satisfactory characteristics as far as the luminance and durability is concerned. As for the tonal display, maximum 64 tones only have reportedly been displayed at the level of trial production.

It is however proposed to adopt in future a technique for 256 tones by address/display separate type drive method (ADS subfield method).

FIGS. 1(*a*) and (*b*) are the drive sequence and drive waveform of the PDP used in this method.

In FIG. 1(*a*), one frame consists of 8 subfields whose relative ratios of luminance are 1, 2, 4, 8, 16, 32, 64 and 128 respectively. Combination of these 8 luminances enables a display in 256 tones. The respective subfields are composed of the address duration that writes in one screen of refreshed data and the sustaining duration that decides the luminance level of the corresponding fields. In the address duration, first wall charge is formed initially at each pixel simultaneously over all the screens for display. The brightness of the subfield is proportional to the number of the sustaining pulse to be set to predetermined luminance. Two hundred and fifty-six tones display is thus realized.

Since said address duration is constant irrespectively of the length of the sustaining duration, the more the number of tones in such an AC drive method, the more the number of bits of the address duration is as the preparation time for lighting up and making the panel luminescent within one frame of duration increases. The sustaining duration as light emitting duration becomes thus relatively short thereby reducing the maximum luminance.

Because the luminance and tone of the light emitted from the panel face depends upon the number of bits of the signal to be processed, increased number of the bits of the signal improves the picture quality, but decreases the emission luminance. If conversely the number of the bits of the signal to be processed is decreased, the emission luminance increases but it decreases the tone to be displayed, causing thus the degradation of the picture quality.

The error diffusion intended to minimize the color depth difference between the input signal and emission luminance rendering the number of the bits of the output drive signal smaller than that of the input signal, is a process to express false tone used when the maximal shade of color is desired to be manifested with lesser tone.

The basic way of thinking for the error diffusion is as follows.

When the image signal is converted from analog to digital, or the digital image signal is converted into that of lower bit number, we should note that the original image signals include an intermediate luminance that cannot be represented by any number of bits of the digital signals thus converted. There arises therefore an error between the original image signal and the image signal as converted, which will degrade the picture quality. The error produced from the conversion is distributed and added (diffused) to surrounding pixels that are spatially and temporally neighboring to each other to display falsely (illusorily) the half tone thereby suppressing the degradation of the picture quality. In general, the error is so distributed and added that the total sum of the errors should be equal to those detected against the image signal, before conversion, of at least one of the neighboring pixels processed after the pixels with error detected. The neighboring pixels processed after the pixels with error detected mean, in a normal display device, the rightneighboring, under-neighboring and right/underneighboring pixels spatially, and those at the same position in the following picture temporarily.

FIG. 2 shows a conventional, general error diffusion circuit, where an image signal with the original picture elements or pixels Ai, j of n (8, for example) bits is input into an image signal input terminal 30. This image signal is processed in a vertical adder 31 and horizontal adder 32, its bit number being reduced to m (4, for example). After passing through an image output terminal 34 and PDP drive circuit, it makes the PDP luminescent.

The ROM 38 in the error detect circuit 35 stores in memory the data of the signal after the conversion (reduction) of the bit number by the bit conversion circuit 33 in a corresponding fashion to the pixel signal before the bit number conversion. When the signal from the foregoing horizontal adder 32 enters the ROM 38, the data outputs of the corresponding signal after the bit number conversion. The adder 39 outputs as an error the difference between the signal from the ROM 38 and the signal from the horizontal adder 32.

The error signal as output from the adder 39 is weighted by predetermined coefficient at the error weight circuits 40 and 41 to get an error detect output. This error detect output is added to the foregoing vertical adder 31 through the intermediary of an h-line delay circuit 36 that outputs a reproduced error E(i, j−1) that has occurred in the pixel by h lines behind the original pixel A(i, j), for example, by one line, and at the same time, it is added to the foregoing horizontal adder 32 through the intermediary of a d-dot delay circuit 37 that outputs the reproduced error E(i−1, j) that has occurred in the pixel by d dots behind the original pixel A(i, j), for example, by one dot.

That is, the reproduced error E(i, j) as detected from the original pixel A(i, j) is added to pixel signal A(i, j+1), by one line behind, through the intermediary of the h-line delay circuit 36, and further to the pixel signal A(i+1, j), by one dot behind, through the d-dot delay circuit 37.

Similarly, the vertical adder 31 adds to the original pixel A(i, j) the reproduced error E(i, j−1) of the pixel A(i, j−1) which is by one line behind, while the horizontal adder 32 adds to the same original pixel the reproduced error E(i−1, j) of the pixel A(i−1, j) which is by one dot behind.

In general, the coefficients at the error weight circuits 40 and 41 shall be so set that the total sum of all these coefficients be one (1).

As a result, 16-tone signal represented by 4 bits is output from the output terminal 34 of the bit conversion circuit 33, and correspondingly the emission luminance level becomes 16-tone as shown by the solid line in FIG. 4. When the drive signal of the original pixel as represented by 8 bits is converted into 4-bit signal at the bit conversion circuit 33, eliminating the lower 4 bits allows in general to give 16 tones with 0 to 15 converted into 9, 16 to 31 into 16, 32 to 47 into 32, . . . and 240 to 255 into 240. After this conversion, we get such stepwise drive signal and emission luminance level as shown by the solid lines in FIG. 4.

Since, however, human eyes recognize the emission luminance of surrounding pixels as spatially and temporally averaged, the display screen after the error diffusion is perceived by human eyes as displaying an intermediate tone that cannot be represented by the 16 tones due to the averaged emission luminance. That is, even though the emission luminance cannot but be represented skippingly as shown by the solid lines in FIG. 4, it is recognized by human eyes as a corrective luminance line of y=x shown by the dotted lines.

The scale of the horizontal and vertical axes in FIG. 4 represent, as maximal value, the maximum 255 when the original pixel is represented by 8 bits.

The driving method as shown in FIG. 1(*a*) adopts 256 tones dividing one frame into 8 subfields. Increasing this number of tones reduces the emission luminance. If, conversely, the bit number of the signal to be processed is decreased composing one frame with 6 subfields as shown in FIG. 3(*a*), the emission luminance increases. If the same is done configuring one frame with 4 subfields as shown in FIG. 3(*b*), the increasing trend of emission luminance becomes greater.

Such half tone display technique as has been described was problematical in that it reduces the resolution and elicits particular patterns because the brightness is diffused in the respective directions of vertical, horizontal and time.

BRIEF SUMMARY OF THE INVENTION

The purpose of this invention is to provide such a driving method and drive that do not allow reduced resolution and elicitation of particular patterns even if the number of bits is reduced of the signal to be processed.

In order to achieve the objective, this invention converts, at the dot/pixel conversion part 50, one dot into 4 pictures: A, B, C, and D. One of the elements, for instance, D is assumed to have entered into the error diffusion circuit 28.

The picture element D, when entering the error detect circuit 35 within the error diffusion circuit 28, is compared with the data that have been previously stored in ROM or memory 38.

When the pixel D is input into the error detect circuit 35, it is compared by the adder 39 with the data after the bit conversion as stored in the ROM 38 to detect the error there between and give an error signal after weighting the error signal with respective predetermined coefficients at the error weight circuits 40, 41 and 53. The error detect signal from the error weight circuit 40 is added to the pixel signal at the vertical adder 31 through the intermediary of the h-line delay circuit 36, the error detect signal from the error weight circuit 41 is added to the pixel signal at the vertical adder 32 through the intermediary of the d-dot delay circuit 37, and finally the error detect signal from the error weight circuit 53 is added to the pixel signal at the diagonal adder 51 through the intermediary of the p-line/d-dot delay circuit 52.

The pixels A, B and C allow to detect the error in a similar fashion to the pixel D.

The vertical adder 31 adds the reproduced error b of the pixel B weighted at the error weight circuit 40 to the pixel D. The horizontal adder 32 adds the reproduced error c of pixel C weighted at the error weight circuit 41. Further, the diagonal adder 51 adds the reproduced error a of pixel A weighted at the error weight circuit 53.

Consequently this invention has the effect that the resolution does not decrease and particular patterns do not appear even if the number of bits is reduced of the signal to be processed.

Other and further objects of this invention will be obvious upon an understanding of the illustrative embodiments about to be described.

DETAILED DESCRIPTION

The basic way of thinking in this invention is as follows.

The reduced resolution in the conventional half tone technique was caused by the diffusion area of half tone which is wider than the required number of dots (resolution).

This inconvenience cannot be dissolved theoretically as far as the display driving method implying "required number of dots=number of picture elements" is adopted.

Note that actually the display device is becoming ever larger, and with this the largeness of one dot is becoming larger and larger. For instance, the size of one dot for 21-inch type PDP is 0.66 mm×0.66 mm, and that for 42-inch PDP is 0.8 mm×0.8 mm.

This invention is characterized in that such display configuration as "required number of dots<number of picture elements" has been realized by displaying one dot by plural pixels to produce the half tone with error diffusion by units of pixels in one dot.

If the half tone is produced and displayed by means of the error diffusion in unit of pixel within one dot, the half tone can be displayed without extending the half tone display area beyond the required number of dots (resolution).

On the drive circuit side, therefore, the half tone display technique with the required number of dots ensured under the conditions of reduced number of bits and increased emission luminance, enables to have a fine image with higher luminance.

Referring now in particular to the drawings, there are illustrated the embodiments of this invention. The invention will be understood more readily with reference to the display device constituting one dot with four pixels; however, these examples are intended to illustrate the invention and are not to be construed to limit the scope of this invention.

Figure 5:
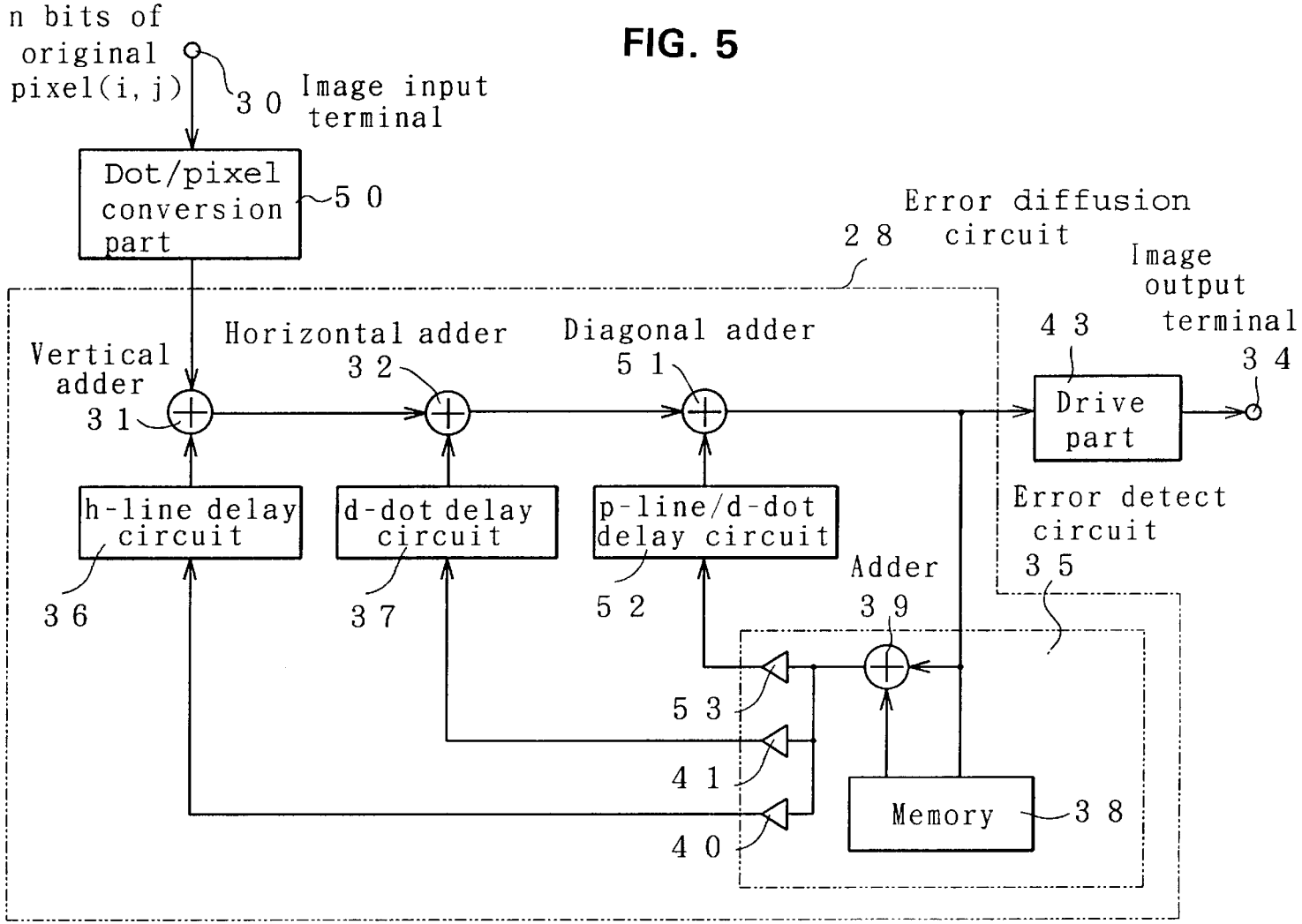
FIG. 5 is a block diagram that depicts an embodiment of the display drive by this invention.

In FIG. 5, the numeral 30 represents an image signal input terminal with n bits of original pixels, to which an image of required number of bits is transferred. The required dots may be, for instance, horizontal 640×vertical 480 dots, equivalent to VGA.

Figure 1A:
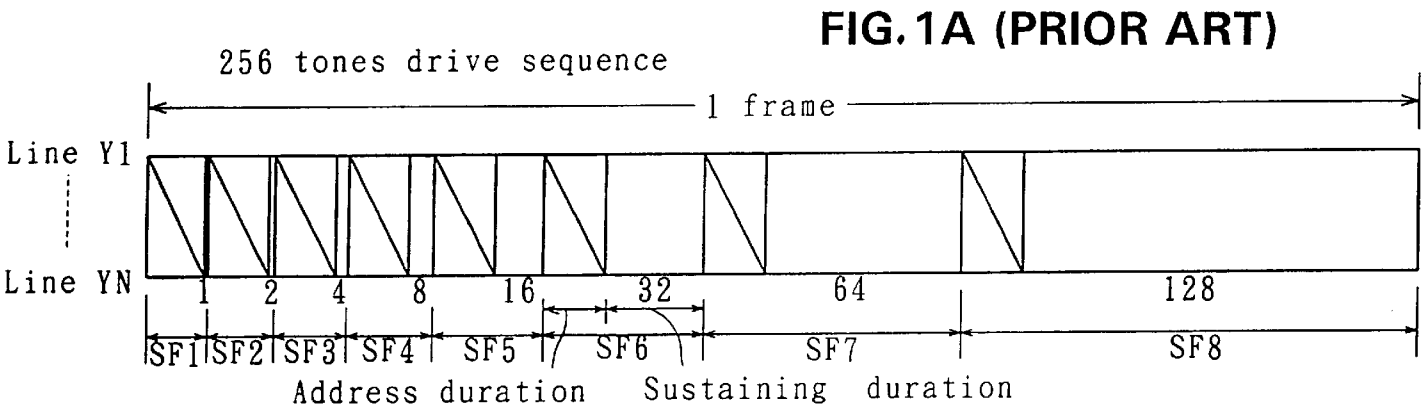
FIG. 1A (PRIOR ART)
FIGS. 1*a* and 1*b* represent the drive sequence and drive waveform in the 256-tone technique.
Figure 1B:
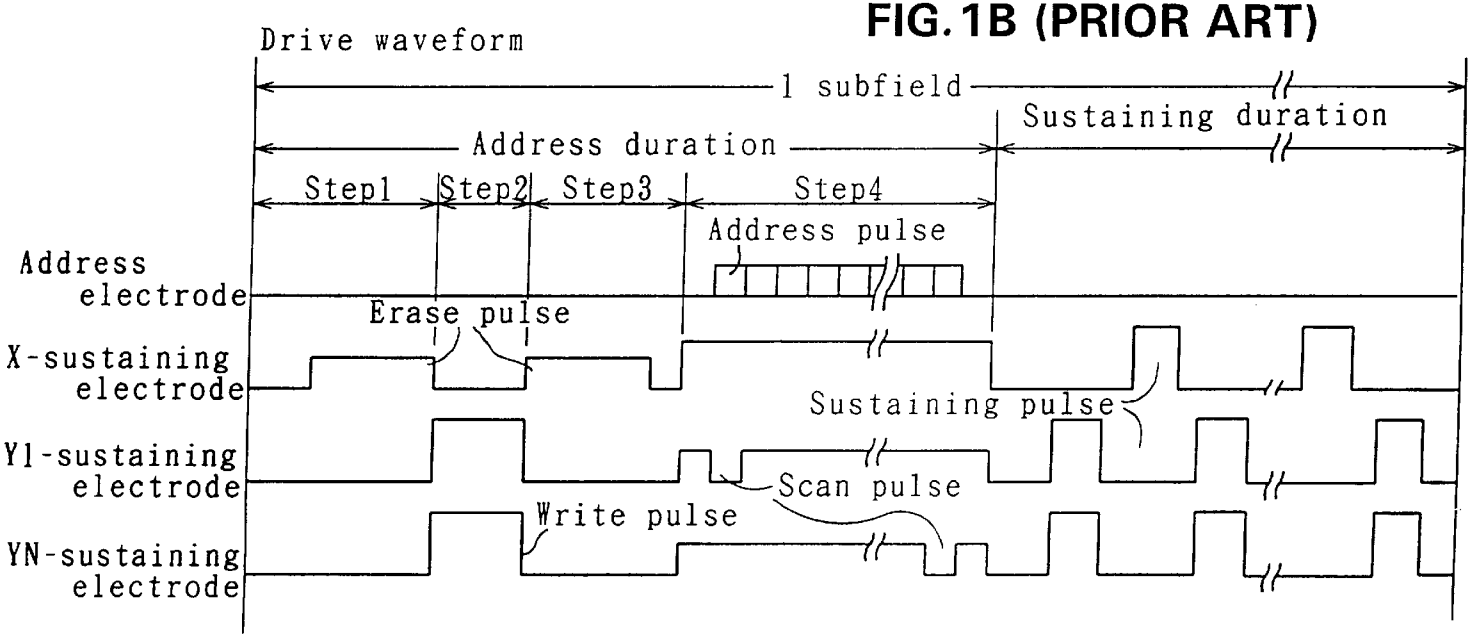
FIG. 1B (PRIOR ART)
Figure 2:
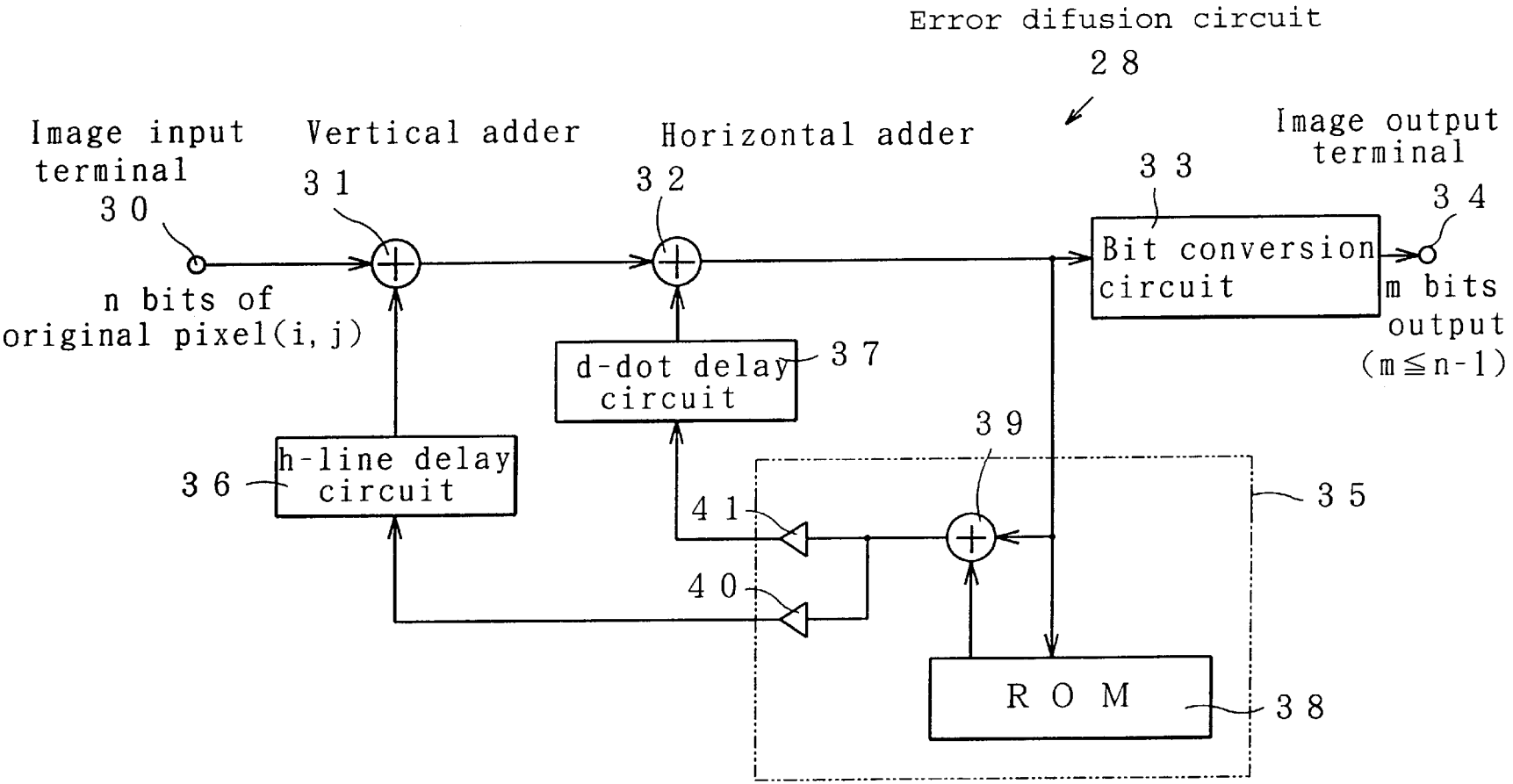
FIG. 2 (PRIOR ART)
FIG. 2 is a block diagram that shows a conventional display drive.

This image signal input terminal 30 is connected to the dot/pixel conversion part 50 that converts one dot into plural, for example, 4 pixels, and further to the PDP as display panel through the error diffusion circuit 28 and the drive part 43, which may or may not include such a bit conversion circuit 33 as shown in FIG. 2 intended to reduce the number of bits of the output drive signal rather than that of the input signal.

The error diffusion circuit 28 consists of a vertical adder 31, a horizontal adder 32, a diagonal adder 51, an error detect circuit 35, an h-line delay circuit 36, a d-dot delay circuit 37, and p-line/q-dot delay circuit 52.

The error detect circuit 35 comprises a memory 38 that stores in memory the level of pixel signal after the conversion (reduction) of bit number by a bit conversion circuit in response to that before the bit number conversion to output the level of the pixel signal after the bit conversion correspondingly to that before the bit number conversion by input of the pixel signal before the conversion, an adder 39 that outputs as the error produced by the bit number conversion the difference between the level after the bit number conversion from the memory 38 and the level of input data, and finally the error loading circuits 40, 41 and 53 that set the distribution rate at which said error is diffused into the pixels by h lines behind, by d dots behind and by p lines and d dots behind respectively by weighting the output from the adder 39 with predetermined coefficients.

The driving part 43 can use lower number of display tones so that the driving is made for respective pixels, if one dot of the image input signal is composed of the half tone output equally divided both vertically and horizontally into four pixels.

In the foregoing configuration, one dot of the image signal of the original pixel as input into the image signal input terminal 30 is converted into plural pixels at the dot/pixel conversion part 50.

The plural pixels undergo the error diffusion processing in pixel unit by the error diffusion circuit 28 to display the half tone.

Figure 6:
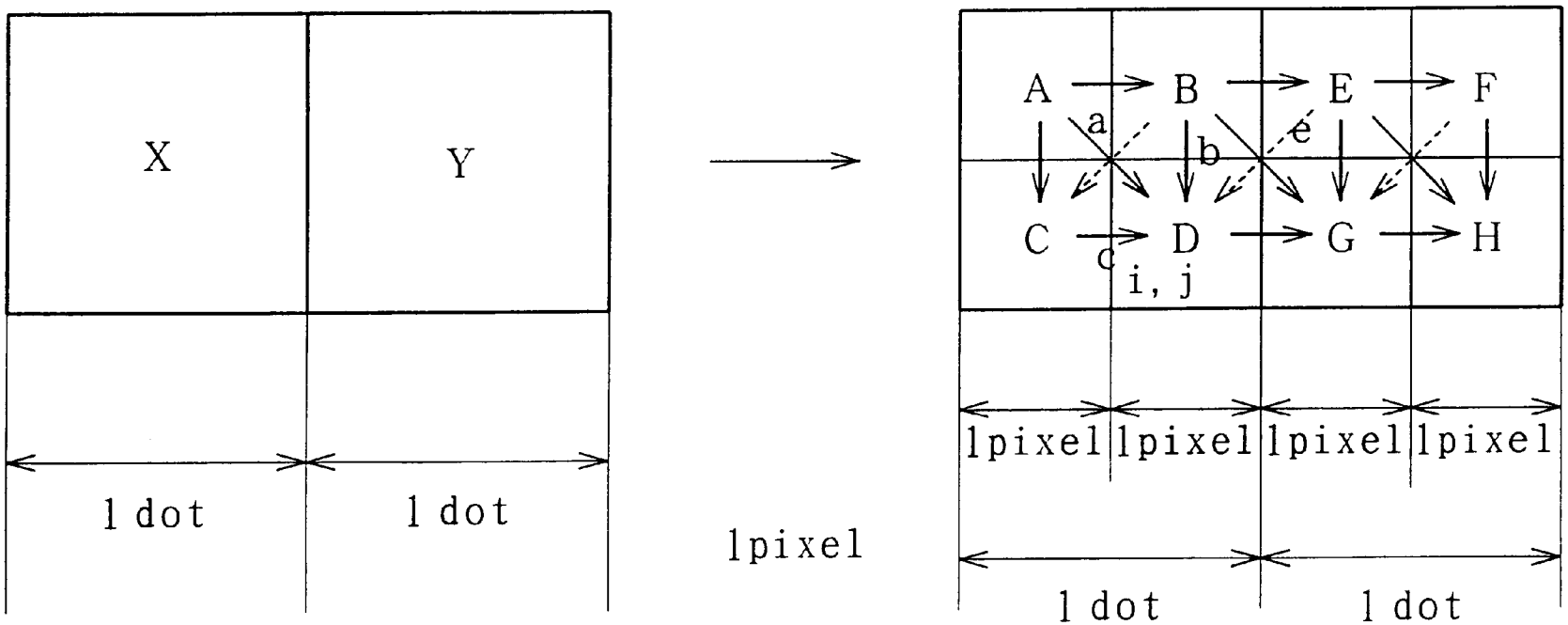
FIG. 6 is an explicative diagram that illustrates the actions of the half tone display by pixel conversion and error diffusion processing according to this invention.

We now assume that the respective single dots of the image signals X and Y of the original pixels input as shown in FIG. 6 are converted into 4 pixels of A, B, C and D on the one hand, and into E, F, G, and H on the other, respectively at the dot/pixel conversion part 50.

The invention is now described referring to the case of the error diffusion of the picture element D (i,j). The dot/pixel conversion part 50 converts one dot into 4 pixels with the pixel D entering into the error diffusion circuit 28.

When the pixel D is input into the error detect circuit 35 through the vertical adder 31, horizontal adder 32 and diagonal adder 51, it is compared by the adder 39 with the data after the bit conversion as stored in the memory 38 to detect the error there between and give an error signal after weighting the error signal with respective predetermined coefficients at the error loading circuits 40, 41 and 53. The error detect signal from the error loading circuit 40 is added to the pixel signal at the vertical adder 31 through the intermediary of the h-line delay circuit 36, the error detect signal from the error loading circuit 41 is added to the pixel signal at the vertical adder 32 through the intermediary of the d-dot delay circuit 37, and finally the error detect signal from the error loading circuit 53 is added to the pixel signal at the diagonal adder 51 through the intermediary of the p-line/d-dot delay circuit 52.

The pixels A, B, and C allow to detect the error in a similar fashion to the pixel D. This error is weighted at the error loading circuits 40, 41 and 53 to be output at the respective adders 31, 32 and 51 through the intermediary of respective delay circuits 36, 37 and 52.

Added, by the vertical adder 31, to the pixel D as output from the dot/pixel conversion circuit 50 is the reproduced error b that is the error of the pixel B as output from the h-line delay circuit 36, that is, by h lines behind and weighted by the error loading circuit 40. The horizontal adder 32 adds the reproduced error c that is the error of pixel C output from the d-dot delay circuit 37, that is, by d dots behind and weighted at the error loading circuit 41. Further, the diagonal adder 51 adds the reproduced error a that is the error of pixel A output from the p-line/d-dot delay circuit 52, that is, by p lines and d dots behind and weighted at the error loading circuit 53.

Generally, the coefficients at the error weighting circuits 40, 41 and 53 are to be set in such a way that the total sum of them should be one (1).

When the respective reproduced errors a, b, a and c are added up and sent to the driving part 43, this part 43, using lower number of display tone, drives the respective pixel units to display the half tone.

Thus producing the half tone performing the error diffusion for pixel unit within 1 dot, allows to display the half tone without extending the half tone display area beyond the required number of dots (resolution).

In the foregoing embodiment the error diffusion has been done for pixel D by combining the reproduced errors a, b, and c. However it is not limited by this combination. It can also be done by such combinations as a only, b only, c only, combinations of a and b, a and c, and b and c. Further e may be added.

Figures 7A, 7B, 7C:
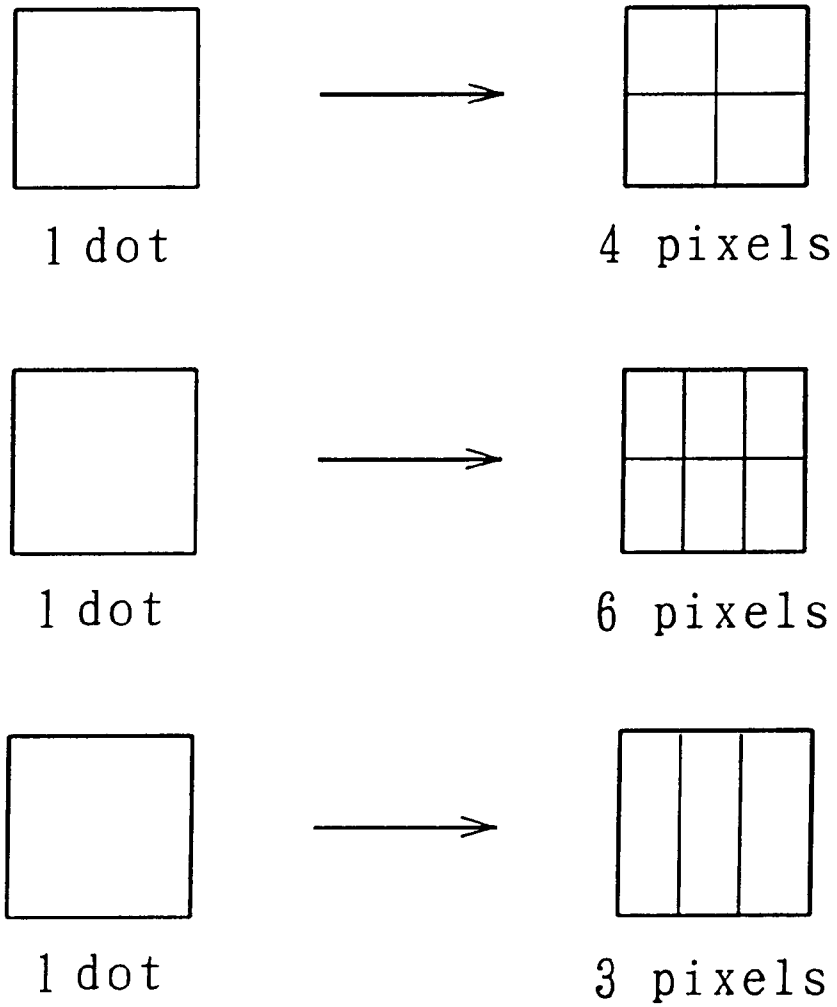
FIGS. 7*a*–7*c* are another explicative diagram showing plural embodiments of the picture element conversion.

Also in the foregoing embodiment one dot of image input signal has been equally divided, as half tone output both vertically and horizontally, into 4 pixels as shown in FIG. 7(*a*), but the invention is not limited to this type of embodiment. One dot of image input signal may be divided, as half tone output, equally divided vertically and trisected horizontally into six panels as shown in FIG. 7(*b*), or else one dot of image input output, only horizontally into three pixels as shown in FIG. 7(*c*).

Thus the number of divisions is all optional both vertically and horizontally.

Figure 3A:
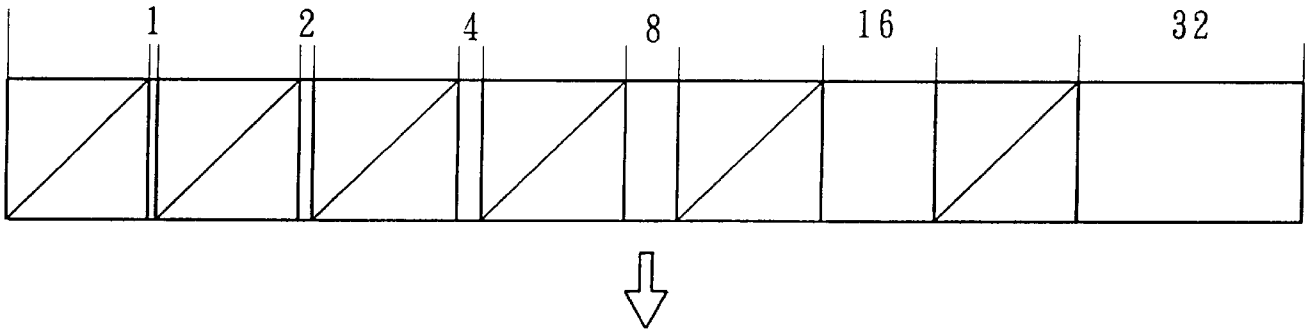
FIG. 3A (PRIOR ART)
In FIG. 3, (a) illustrates the drive sequence in 64-tone technicity and (b) the drive sequence in 32-tone one.
Figure 3B:
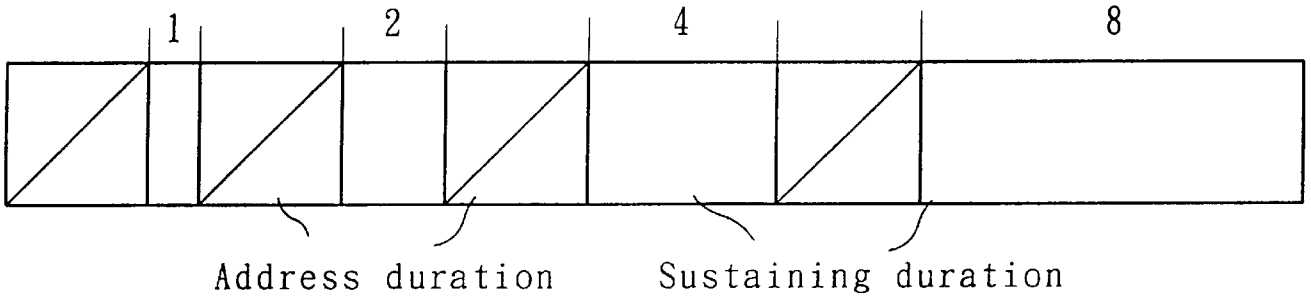
FIG. 3B (PRIOR ART)
Figure 4:
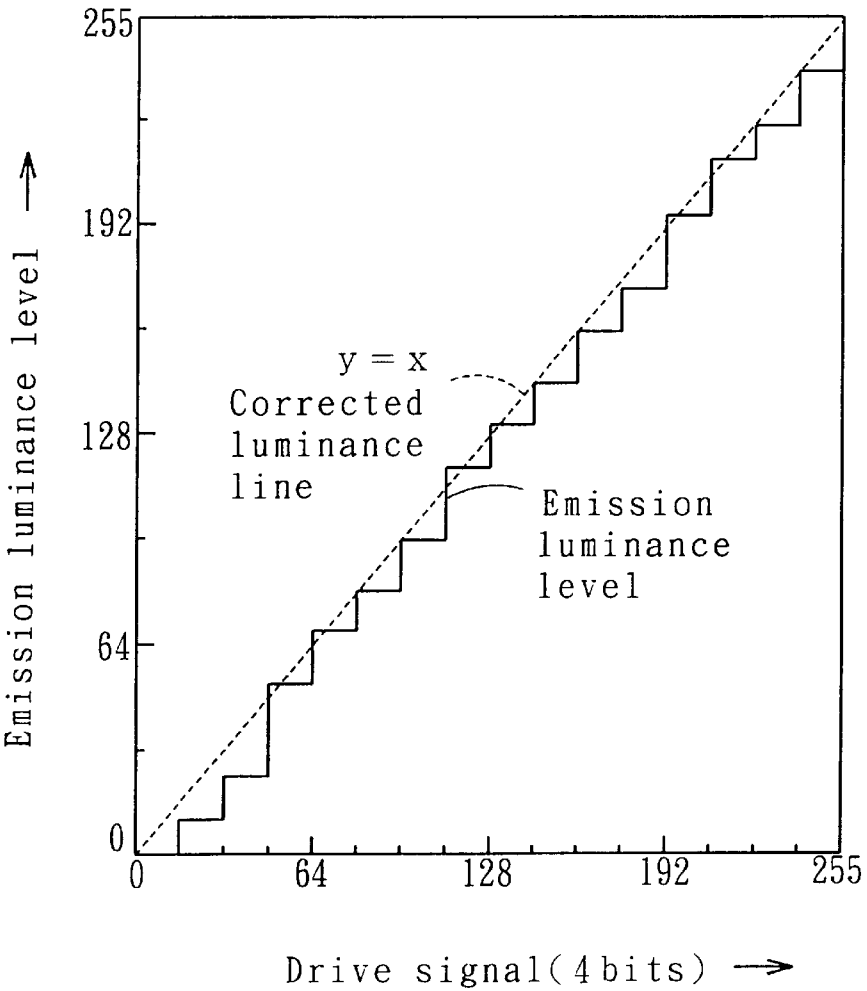
FIG. 4 (PRIOR ART)
FIG. 4 gives the characteristic line of drive signal vs. emission luminance level in a conventional circuit.

In the foregoing embodiment, the image signal of the original picture elements input into the image signal input terminal 30, may reduce the number of bits of the signal to be processed by configuring one frame with 6 subfields as shown in FIG. 3(*a*), or with 4 subfields as shown in FIG. 3(*b*), all having such steplike luminance levels with larger level differences than in FIG. 4.

What is claimed is:

1. A display drive for providing signals to display a half tone on a display panel and including an error diffusion circuit that obtains a false half tone diffusing, in surrounding pixels, of the luminance error of data of an image signal of original picture elements quantifiedly input and preceding data, comprising:

a dot/pixel conversion circuit configured to convert one dot of an original pixel image signal into plural pixels, the error diffusion circuit receiving the plural pixels, and including:

an error detect circuit configured to output, for every pixel, anyone or more reproduced errors in at least two of vertical, horizontal and diagonal directions based on the input data and the preceding data, stored beforehand, a delay circuit configured to delay the reproduced errors, and an adder configured to add the output of the delay circuit for every pixel of the input signal as it is input;

a driving circuit receiving the reproduced error for every pixel and providing the signals to display the half tone with respective pixels which have undergone error diffusion.

2. The display drive of claim 1, wherein the error detect circuit comprises a memory configured to store, beforehand, past data, another adder for adding the data from the memory to the input data as it is input, and an error weighting circuit configured to weight the added data from the other adder by predetermined coefficients to output the reproduced error generated between the error detect circuit output and the pixel prior to the original picture element.

3. The display drive of claim 2, wherein the display panel comprises one of a plasma display panel and liquid crystal display panel.

* * * * *